US007730841B2

(12) United States Patent
Wang

(10) Patent No.: US 7,730,841 B2
(45) Date of Patent: Jun. 8, 2010

(54) SLING TABLE

(75) Inventor: Oliver Wang, Millbrae, CA (US)

(73) Assignee: Agio International Company, Ltd., Hong Kong (HK)

( * ) Notice: Subject to any disclaimer, the term of this patent is extended or adjusted under 35 U.S.C. 154(b) by 233 days.

(21) Appl. No.: 12/074,152

(22) Filed: Feb. 29, 2008

(65) Prior Publication Data

US 2009/0217845 A1 Sep. 3, 2009

(51) Int. Cl.
*A47B 17/00* (2006.01)

(52) U.S. Cl. ..... 108/27; 108/90; 108/153.1; 5/110

(58) Field of Classification Search ..... 108/90, 108/27, 11, 13, 14, 161, 28, 180, 153.1, 154, 108/157.14, 158.13; 5/625, 7, 110, 111; 248/63, 62, 60, 74.2
See application file for complete search history.

(56) References Cited

U.S. PATENT DOCUMENTS

| | | | | | |
|---|---|---|---|---|---|
| 2,903,312 | A | * | 9/1959 | Lawless | 108/13 |
| D276,134 | S | * | 10/1984 | Ericsson | D8/396 |
| 4,656,953 | A | | 4/1987 | Miller, Jr. | |
| 4,716,840 | A | * | 1/1988 | Tringali et al. | 108/27 |
| 4,841,878 | A | | 6/1989 | Kriegsman | |
| 5,066,078 | A | * | 11/1991 | Wurst | 312/114 |
| 5,339,748 | A | | 8/1994 | Bilotti | |
| 5,546,873 | A | * | 8/1996 | Conner et al. | 108/90 |
| 5,697,305 | A | | 12/1997 | Chasan et al. | |
| D437,504 | S | | 2/2001 | Giron | |
| 6,367,392 | B2 | | 4/2002 | Moore | |
| 6,370,714 | B1 | * | 4/2002 | Elzenbeck | 5/110 |
| 6,511,562 | B1 | * | 1/2003 | Coffield | 5/110 |
| 6,598,836 | B1 | * | 7/2003 | Leon | 248/74.1 |
| 6,618,879 | B1 | * | 9/2003 | Wu | 5/111 |
| 6,715,849 | B2 | | 4/2004 | Fink | |
| 6,823,804 | B2 | * | 11/2004 | Arnell | 108/90 |
| D501,335 | S | * | 2/2005 | Stangl et al. | D6/422 |
| 7,004,066 | B2 | | 2/2006 | Poo | |
| 7,044,067 | B2 | | 5/2006 | Saccomandi | |
| 7,207,530 | B2 | * | 4/2007 | Ismert et al. | 248/74.4 |
| 2006/0231689 | A1 | * | 10/2006 | Caminita | 248/74.3 |

* cited by examiner

*Primary Examiner*—José V Chen
(74) *Attorney, Agent, or Firm*—Williams Mullen; M. Bruce Harper

(57) ABSTRACT

A sling table is disclosed having a transparent top and a decorative fabric sling visible through the transparent table top. A frame defines an inner opening of a desired shape. The transparent table top is mounted to the frame in a substantially horizontal orientation. The fabric sling is mounted to the frame within the inner opening via sling rods. The fabric of the sling may match or complement fabric of other pieces of furniture, and may be replaced without having to replace the table top.

28 Claims, 13 Drawing Sheets

SLING TABLE

FIELD OF INVENTION

The present invention relates to a table featuring a transparent top and a fabric sling mounted so as to be visible through the transparent top, including a sling mount for such tables.

BACKGROUND OF THE INVENTION

The tops of most tables are generally made of solid, opaque materials. Given the customary uses for tables, the tops, leaves, or extensions are typically intended to be permanently connected to the supporting frame or legs. Given this fixed characteristic, the decorative possibilities of most tables are somewhat limited.

Some tables have table tops made of glass or other transparent material. One category of these tables, which is commonly seen in outdoor furniture, provides a glass surface with a supporting metal frame. The glass table top may be frosted, tinted, or transparent, etc. As with other fixed top tables, the decorative possibilities for this category are limited to the original treatment of the table top. For example, a set of outdoor furniture may include several chairs in combination with glass topped table. The fabric of cushions or slings of the chairs likely would have some decorative features or colors. The glass surface may then be offered in a tinted or complementing color.

Given the different materials involved, it is often difficult to match the color of the glass to the color of the fabric. If the owner changes the fabric of the chairs, then the table top would no longer match the rest of the set. In addition, glass tinted to match furniture fabric is generally more expensive than clear glass and the tinting step slows and complicates the assembly process.

FIGS. 1A-1C are views of conventional glass topped tables. As noted above, the glass tabletop may be clear, frosted, or tinted to a desired color that complements the color of the companion chairs. Such a table is limited in decorative options because the table top style is fixed in a permanent form. Further, it is difficult to match a glass table top to complement the color of companion chairs. In addition, coloring the glass adds time and cost to the assembly process.

Another category of table falls under a variety of names, such as display, shadow box, or advertising tables. For example, such a table provides a support surface underlying a transparent layer, such as glass. The support surface is then used to support a decorative design, item, or advertisement that can be seen through the transparent layer. Commonly, such tables are used for menus, photographs, or advertisements, to be placed between the support surface and the glass. In some cases, the placement is permanent; in other cases, the items may be varied. Although this category may permit changing the decorative themes, it is generally not practical for uniting a table decoratively with a set of chairs. First, shadow box tables are more expensive and more complicated in construction in order to retain, support, and protect the decorative items. Further, this design requires the addition of the underlying support surface, with its attendant weight and assembly complication. In short, such designs have a double layered top.

These previous structures do not provide the operational features of the present invention.

SUMMARY OF THE INVENTION

The present invention is a table having a transparent top and fabric sling mounted underneath, so as to be visible through the transparent top. The sling table has a frame with an upper portion and a lower portion, wherein the frame defines an inner opening having a desired shape in a horizontal plane. The frame also includes at least a first and second substantially opposing inner surface. A transparent table top is mounted to the upper portion of the frame in a substantially horizontal orientation.

At least two sling rods are provided along with a fabric sling having a shape and size so as to fit within the inner opening. The at least a first and second substantially opposing edges of the sling may be positioned substantially proximate to the opposing inner surfaces of the frame. The sling further includes at least a first and a second sleeve located at and along the first and second opposing edges of the sling. The sleeves define inner channels along the length of the first and second opposing edges of the sling. The sling further defines at least one access hole in communication with each of the inner channels, so that the sleeves are each adapted to receive the at least two sling rods via the access holes.

At least two sling rod mounts are affixed to opposing inner surfaces of the frame, the sling rod mounts being sized to receive the at least two sling rods when they are located within the first and second sleeves. Alternatively, the frame may define first and second lower surfaces as the first and second inner surfaces, and the sling rod mounts may be affixed to these lower or downward facing surfaces.

Preferably, the sling and sling rod mounts are configured with relation to the frame and the table top such that the sling is visible through the transparent table top. The lower portion of the frame is adapted to support the frame and table top at a desired height.

The sling table frame may take a number of different forms, such as a pedestal, or traditional legged form. Legged forms may include one or more legs, and multiple legged forms may comprise at least one transverse member interposed between at least two of the plurality of legs.

The table top may be mounted to the frame in a variety of ways, whether fixed or removable. For example, the upper portion of the frame may further define an upper surface and the transparent table top may be mounted onto at least a portion of this upper surface. The transparent table top may be made of any transparent, structural material suitable for table tops, including various types of glass, plastics, acrylic glass, etc.

The sling rod mounts may incorporate various additional features. In some embodiments, the sling rod mounts may removably receive the at least two sling rods when located within the first and second sleeves. The sling rod mounts may be have a C-shaped cross section and be sized to receive the at least two sling rods when located within the first and second sleeves. The sling rod mounts may removably receive the at least two sling rods when located within the first and second sleeves. The sling rod may include an integrated fastening member along its length. Optionally, the integrated fastening member may have a truss shaped cross section, which can have a rectangular cross section.

Thus, an aspect of the invention is a sling rod mount for use with the table described herein, comprising an elongated and resilient member having a C-shaped cross section forming an annular opening along its length, wherein the C-shape cross section and annular opening are configured with respect to the diameter of a sling rod to receive the sling rod when located within a sleeves of a sling, and at least one integrated fastening member depending from the member defining a surface adapted to receive a fastener whereby the sling rod mount may be removably fastened to the sling table.

In some embodiments, the sling rod may be sufficiently flexible so as to support use with arcuate shaped sling rod mounts. In that case, an alternative embodiment may have a single sling rod mount having some degree of an arcuate shape, such that it may be possible for a sling to be mounted within the inner opening using a single sling rod and sling rod mount.

DETAILED DESCRIPTION OF THE PREFERRED EMBODIMENTS

Embodiments of the present invention provide a table having the utility of a conventional table top with improved decorative flexibility and ease of assembly. In addition, the table of the present invention is capable of more accurately matching the color and texture of fabric used in any companion chairs or other items.

Figure 1A:
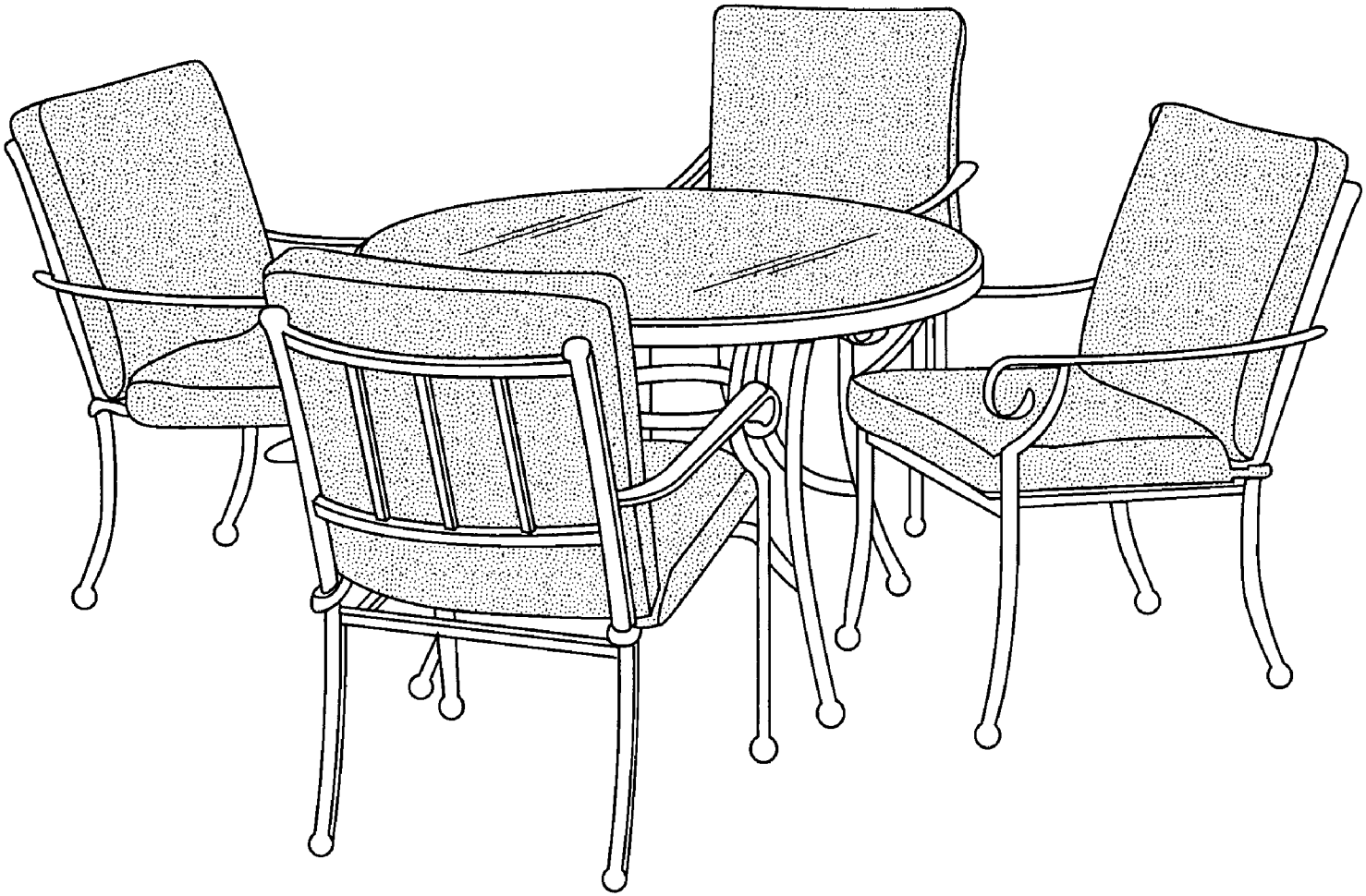
FIG. 1A PRIOR ART
FIG. 1A-1C are examples of prior art tables.
Figure 1B:
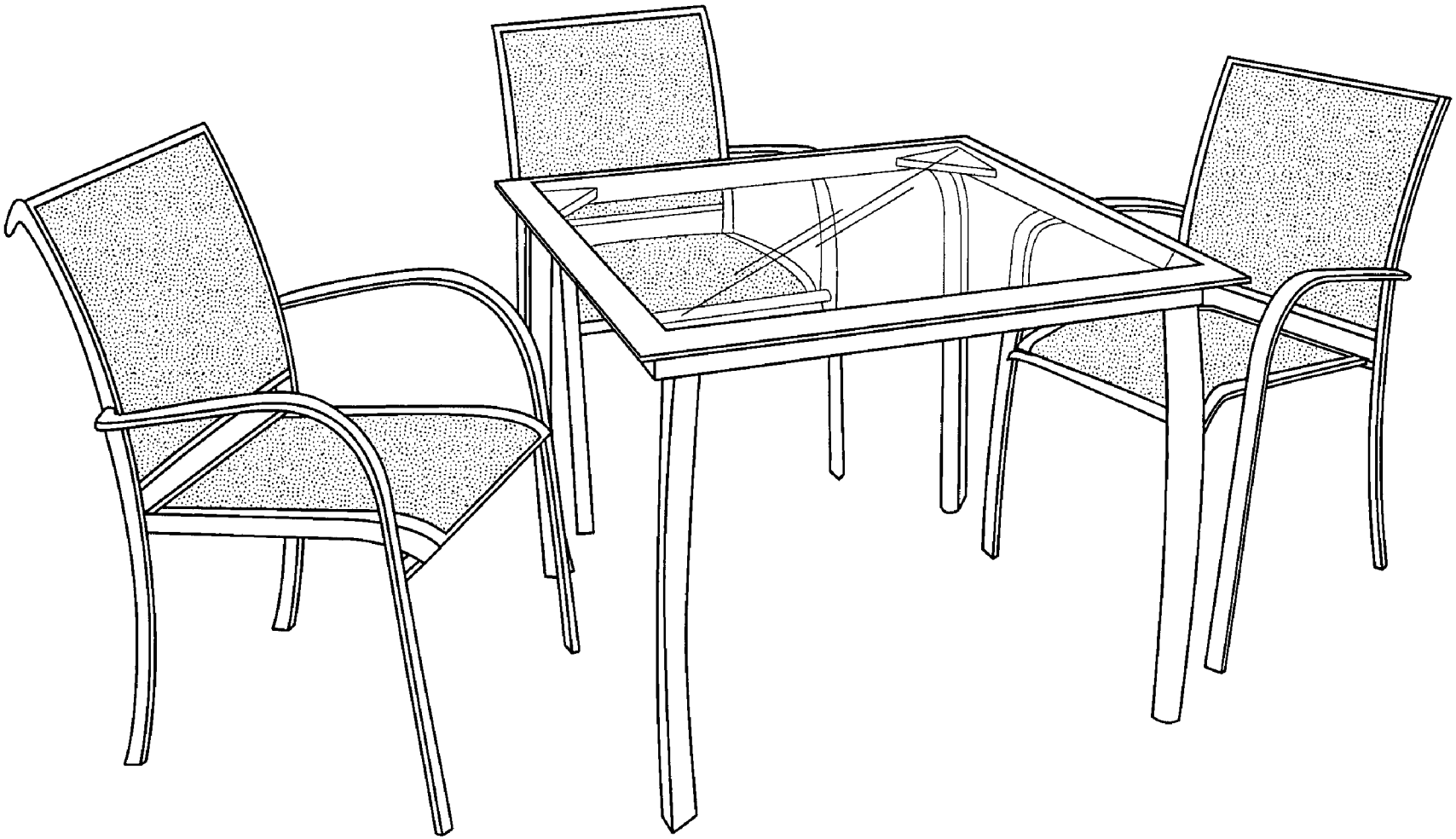
FIG. 1B PRIOR ART
Figure 1C:
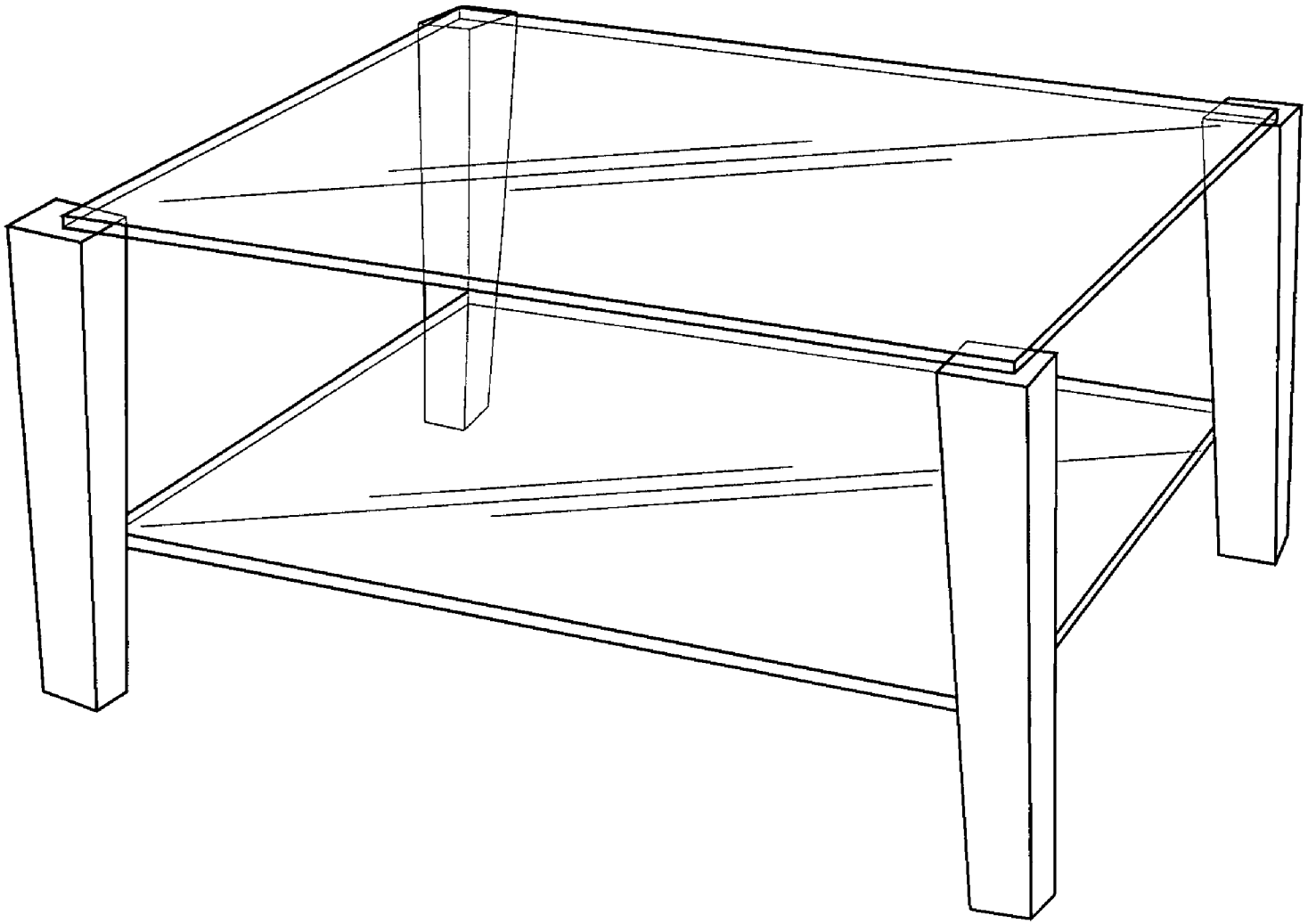
FIG. 1C PRIOR ART
Figure 2A:
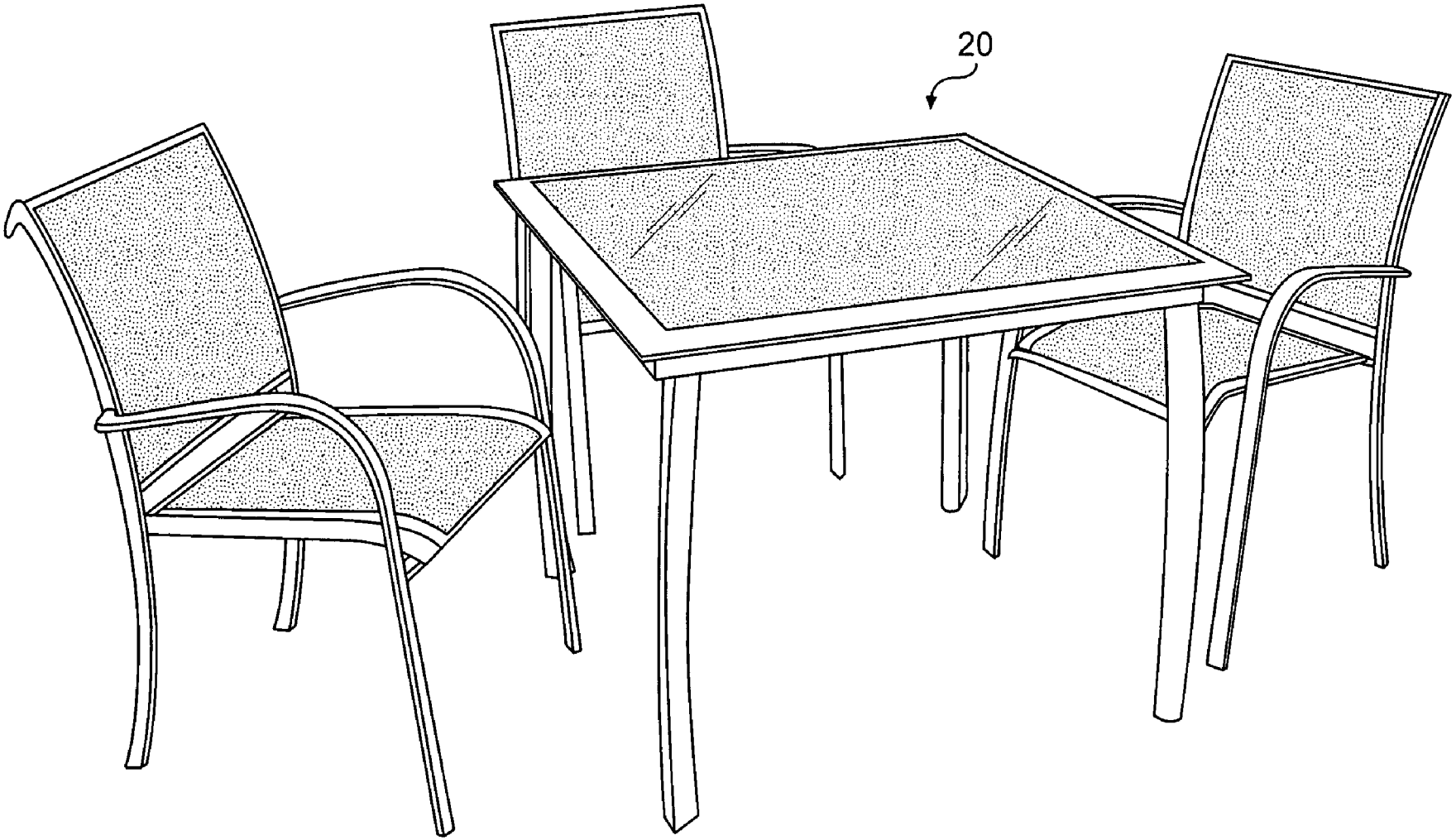
FIGS. 2A-2B illustrate aspects of an embodiment of the invention.
Figure 2B:
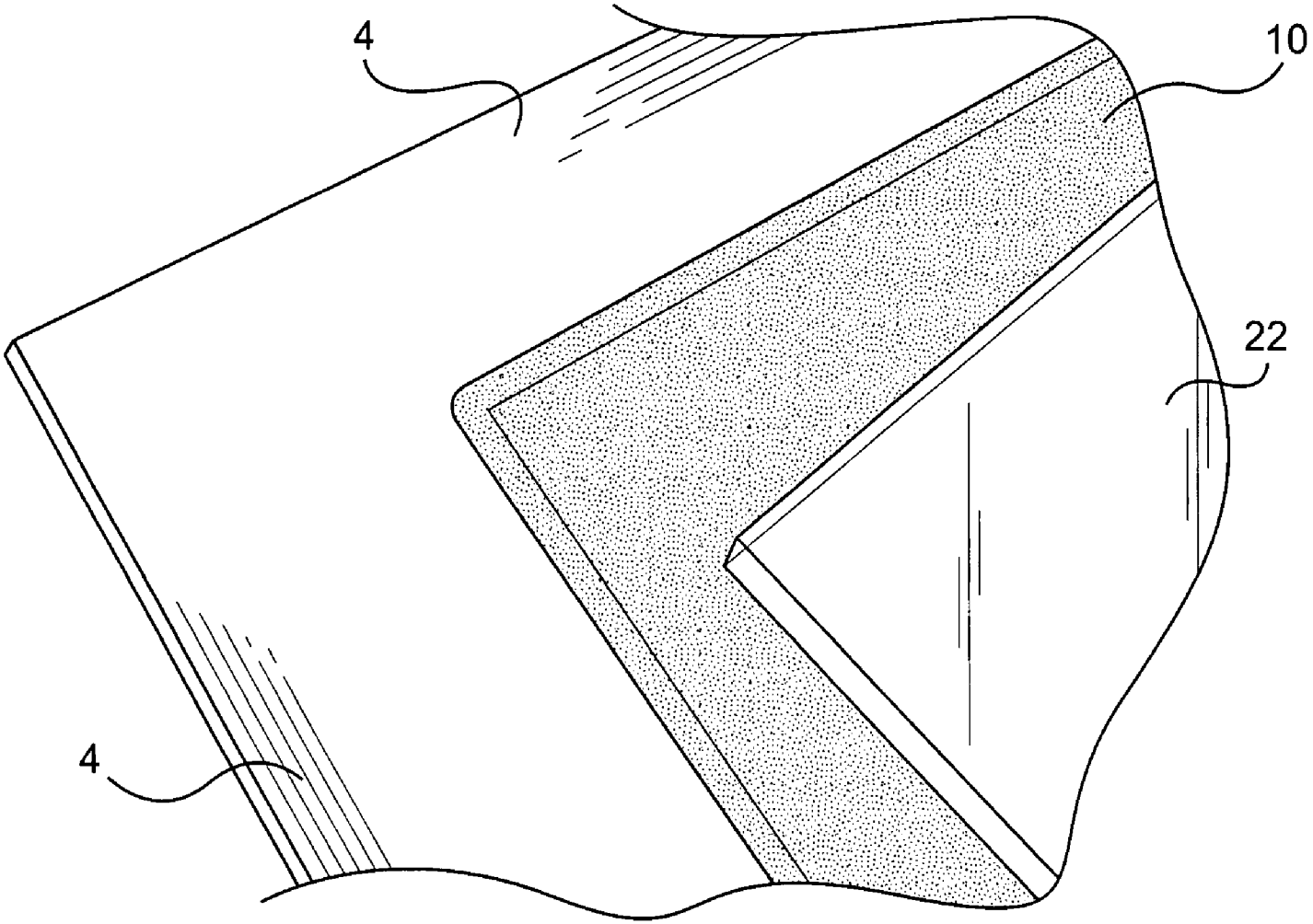

FIG. 2A is a perspective view of an embodiment of the table 20 of the present invention. This innovation provides a way to enhance the decorative options available for glass top tables and to avoid the complications and limitations associated with tinting glass. As may be seen in FIG. 2B, a piece of fabric, such as sling 10 is preferably removably mounted underneath a transparent table top 22. Thus, sling 10 is visible through transparent table top 22. The sling 10 preferably is of a desired material, color, weave, texture, and/or pattern, so as to complement or match the fabric or material used in companion pieces of furniture. Table top 22 may be of any transparent, substantially rigid substance, such as glass. For the purposes herein, the term "glass" should be construed broadly to mean any transparent, structural material suitable for table tops, including but not limited to silica based glass, non-silica glass, safety glass, crystal, and plastic.

Figure 3:
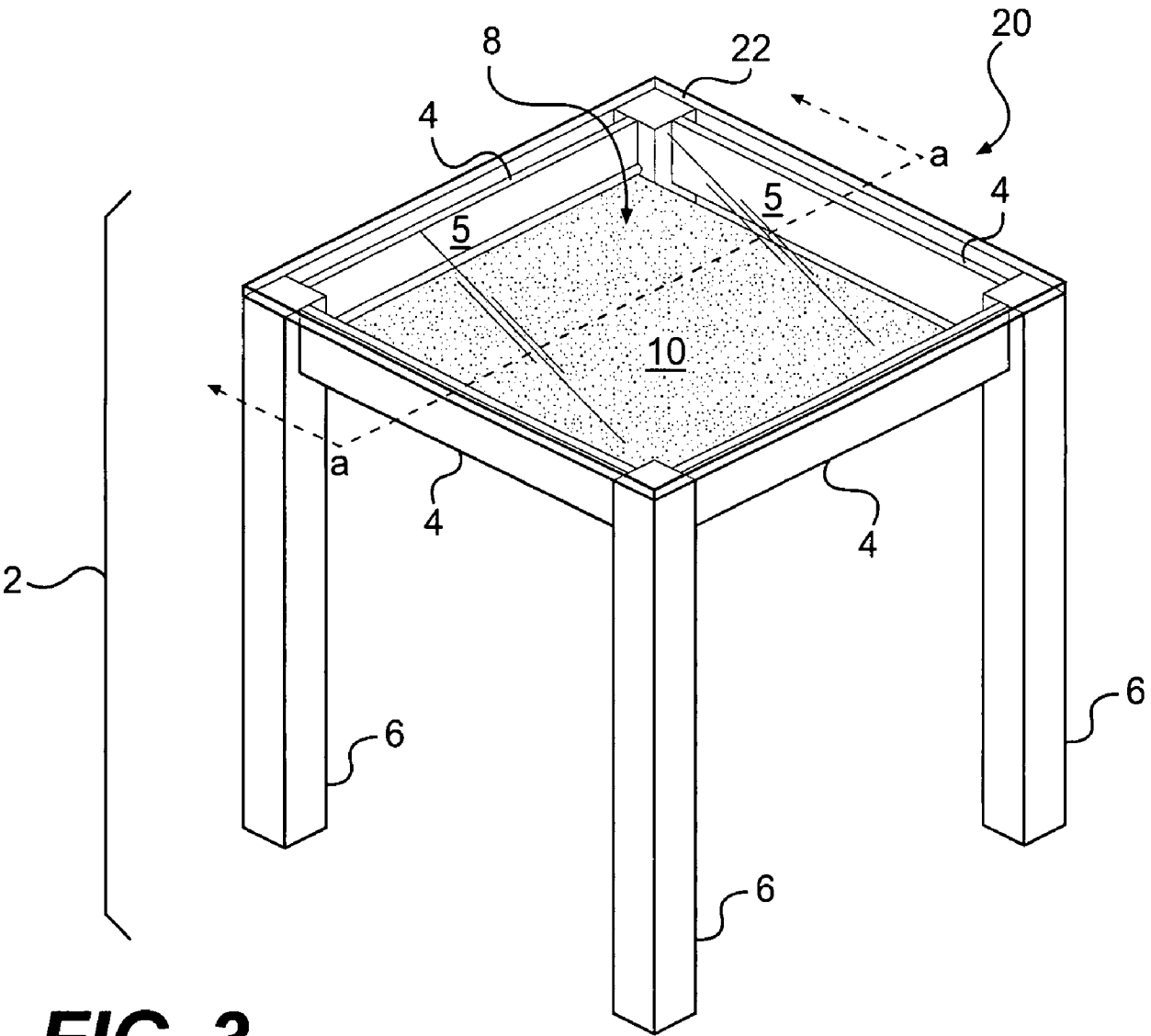
FIG. 3 is a perspective view of an embodiment of the present invention.

FIG. 3 is a perspective view of an embodiment of table 20 of the present invention. Frame 2 is shown in this embodiment as including horizontally oriented or transverse members 4 and legs 6; the transverse members 4 are interposed between legs 6, forming frame 2. The word "interpose" is intended to mean that it provides structure between legs 6, without limiting how members 4 attach to legs 6. Of course, transverse members 4 could attach to legs 6 in a variety of configurations, including outside legs 6, atop legs 6, inside legs 6, or as shown. Table top 22 is shown resting on an upper surface of an upper portion of frame 2 (i.e., upper parts of legs 6 and transverse members 4), while the legs 6 depend therefrom as a lower portion of frame 2 (i.e., lower parts of legs 6).

As discussed further below, the number of transverse members 4 may vary and in certain embodiments of table 20, frame 2 may have no transverse members 4, depending on the application and desired design. Further, the number of legs 6 may also vary. Frame 2 may take the form of a hollow pedestal, hollow square, trestle, or other vertical support, so long as it defines inner opening 8. As shown in FIG. 3, frame 2 defines an inner opening 8 in a rough horizontal plane by the configuration of transverse members 4 and legs 6, such that inner surfaces 5 (visible though transparent table top 22) of transverse member 4 and legs 6 face inward toward inner opening 8. Frame 2 may be fabricated from a variety of materials used in furniture, depending on the intended application.

For this embodiment, inner opening 8 is roughly a square shape within the horizontal plane. However, inner opening 8 may be any of a wide variety of desired shapes, and the outer perimeter of inner opening 8 need not be parallel to or matching the outer shape of frame 2 or the edge of transparent table top 22. For example, an embodiment of table 20 having a round outer rim to table top 22 could also have an inner opening 8 that was not round, such as a square, polygon, or other shape. Preferably, inner opening 8 is in the shape of a polygon for ease of construction and design.

A fabric sling 10 (visible through transparent table top 22) is mounted within inner opening 8. Thus, sling 10 has an overall shape and size so as be able to fit within the inner opening 8. Fabric sling 10 may be mounted so that the fabric is stretched tight, or is given a degree of slackness to form a hanging arc, or some other desired appearance, so long as it does not interfere with any seating, if applicable. A preferred aspect of the present invention is the mounting of fabric sling 10 using, for example, a mounting arrangement such as sling rods 12 (not shown) and sling mounts 14 (not shown) as detailed below in FIGS. 9-13. This arrangement provides ease of assembly, light weight structure, and secure mounting in a desired position underneath table top 22 without the need for an additional surface to support fabric sling 10. This arrangement also offers the option of flexibility to replace the sling 10, as desired. As noted above, sling 10 may be fabricated from a variety of materials, preferably a woven fabric or pliable panel material.

Figure 4:
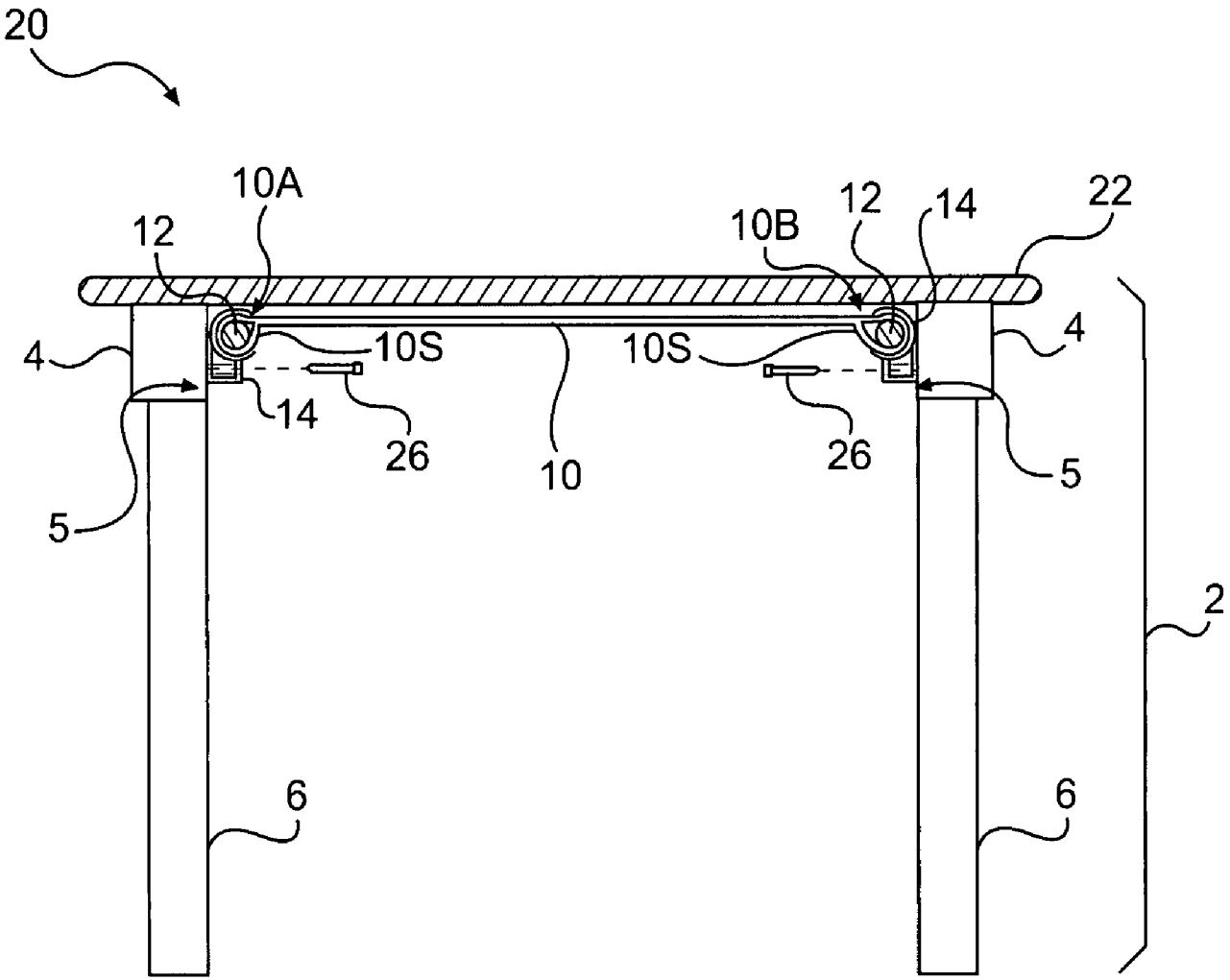
FIG. 4 is a side view of an embodiment of the present invention.
Figure 5:
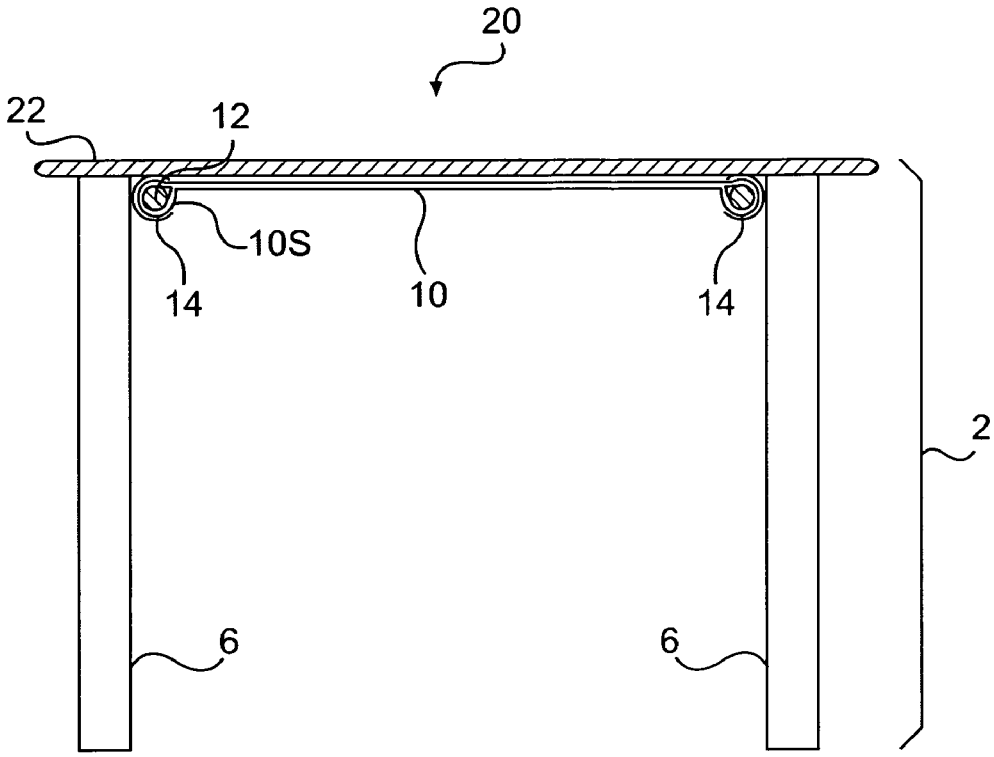
FIG. 5 is a side view of an embodiment of the present invention.
Figure 6:
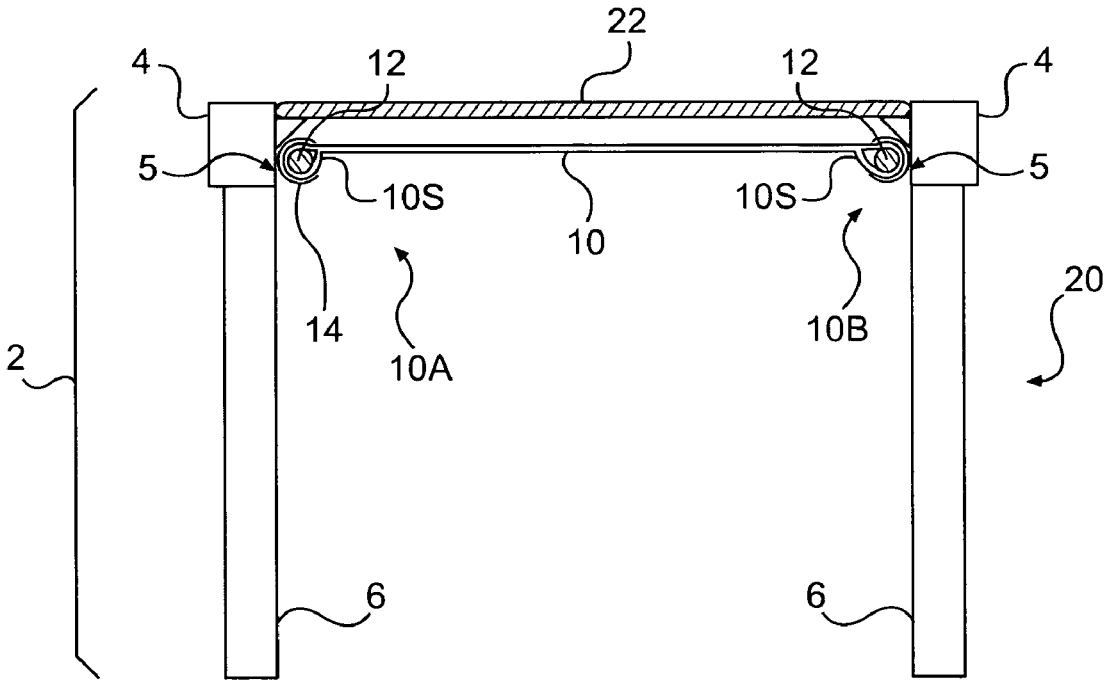
FIG. 6 is a side view of an embodiment of the present invention.

FIGS. 4-6 show side view cross sections of various embodiments of table 20, roughly corresponding to cross section line a-a of FIG. 3. With reference to FIG. 4, it may be seen that sling 10 has first and second sleeves 1OS located along first edge 10A and second edge 10B, which are situated at substantially opposing ends of sling 10.

Within the present invention, "substantially opposing" should include a wide variety of spatial relations, depending on the shape of sling 10 and the desired tightness of the mount. A tight mount would preferably involve sleeves 10S in more substantial, but not necessary complete or fully matching, parallel opposition, as shown in FIG. 4. However, substantial opposition may also include acutely angled edges. In some cases, for example with an equilaterally triangular sling 10 (see, e.g., FIG. 8), if each of the edges included a sleeve 10S then the sleeves 10S would effectively be opposing for the purpose of support against gravity, and thus should still be construed as falling within the meaning of substantially opposing. In contrast, if only two adjacent edges of a regularly hexagonal sling 10 had sleeves 10S, then the sling 10S would clearly not provide sufficient mounting support against gravity for much of the sling 10; in other words, the sleeves 10S would not be effectively opposing, as most of the sling would hang loose from the horizontal, and thus such sleeves 10S would fall outside the meaning of substantially opposing. Thus, substantially opposing generally means opposing for the purpose of supporting sling 10 against gravity.

A preferred embodiment provides sleeves 10S on all edges of sling 10. However, such redundancy may not be desired or required for a particular embodiment. For example, a low cost embodiment may simply have sleeves 10S on two substantially opposing sides of a square sling 10 (see, e.g., FIG. 7).

As may be seen in the embodiments of FIGS. 4-6, at least two sling rod mounts 14 may thus be affixed on substantially opposing inner surfaces 5 of frame 2. Inner surfaces 5 may be located on transverse members 4, legs 6, or some other component of frame 2. In FIG. 4, opposing portions of transverse member 4 define first and second inner surfaces 5. Of course, frame 2 may take a variety of configurations, and may define inner surfaces facing in other inner directions, such as downward facing, etc. that can be used. Thus, an alternative embodiment includes sling rod mounts 14 adapted to being affixed to these other inner surfaces. Thus, "inner" surface is intended generally to include surfaces accessible to or somehow facing inner opening 8 of table 20.

Figure 10:
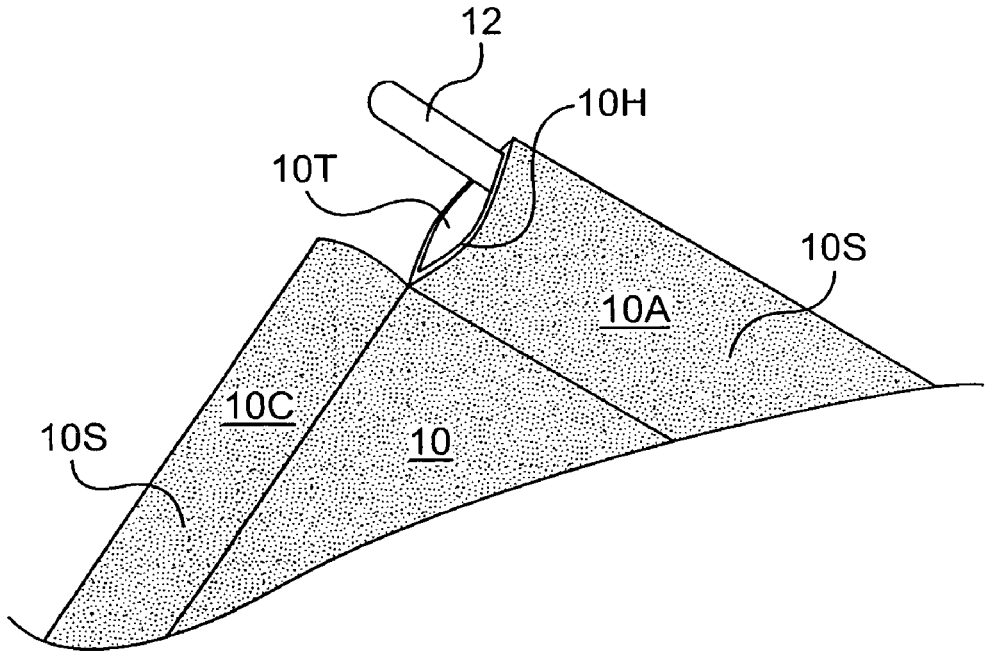
FIG. 10 illustrates a sling and sling rod of an embodiment of the present invention.

A brief reference to FIG. 10 provides some initial details of sling 10. Sleeves 10S define inner channels 10T (shown partially) that are shown as running along edges 10A and 10C of sling 10. The sling 10 further defines access holes 10H that are in communication with each of the inner channels 10T. Sleeves 10S are each adapted to receive sling rods 12 into inner channel 10T via access holes 10H. Sling rod 12 is shown partially inserted into one of sleeves 10S. This illustration of a roughly square embodiment of sleeve 10 shows sleeves 10S on edges 10A, 10C, but does not show sleeves 10S that are located on edges 10B, 10D.

Returning to the embodiments of FIGS. 4-6, sling rod mounts 14 should be sized and configured to receive and support sling rods 12 when inserted into sleeves 10S of sling 10 along annular opening 15 (not shown). Inner opening 8 (not shown) and sling 10 preferably are configured so that the first and second opposing edges 10A, 10B of sling 10 may be positioned substantially proximate to the appropriate opposing inner surfaces 5 of frame 2. Substantially proximate simply relates to proximity of sleeves 10S sufficient to reach sling mounts 14. However, sling 10 is not required to be proximate to all of the inner surfaces defining inner opening 8 (not shown).

Sling rod mounts 14 may be affixed to frame 2 in a variety of ways. As shown in FIG. 4, for example, sling rod mounts 14 are affixed to transverse members 4 by fasteners 26 (e.g., screws, clips, rivets, etc.) Preferably, the affixation is by removable means, which would permit sling mount 14 to be removed and sling 10 to be easily changed. However, embodiments having more permanent affixation, such as welds or adhesives, may also be desirable in some cases. In a preferred embodiment, sling rod mount 14 can be affixed to frame 2 while engaging sling 10. This permits a tighter, more secure engagement between sling rod mount 14 and sling 10. Alternatively, sling rod mount 14 may have a looser engagement with sling 10; for example, in some embodiments sling 10 may be replaced while sling rod mount 14 remains affixed to frame 2, so long as sling rod 12 (while within sleeve 10S) may be disengaged from sling rod mount 14.

As noted above, the present invention should be construed as extending to include embodiments in which inner opening 8 is larger than sling 10, if desired. In such examples, portions of inner opening 8 may not be filled by sling 10. Conversely, in the event that sling 10 were desired to be larger than inner opening 8 in some dimension, then preferably provision may be made for folding or otherwise managing any excess material of fabric sling 10.

FIG. 5 is an embodiment with sling mounts 14 affixed directly to legs 6. In such an embodiment, sling mounts 14 are preferably sufficiently rigid so as to support sling 10 at a desired tautness between legs 6. Optionally, sling mounts 14 may also be sufficiently rigid to provide transverse rigidity for frame 2, if desired.

The contemplated invention offers considerable variability in the shape of sling 10, which enables the potential for considerable variability in choice of first and second edges 10A, 10B, and for placement of sleeves 10S on sling 10. Further, the shape of sling 10 may affect the shape and requirements for sling rods 12. For example, a sling 10 having an arcuate edge may be supported with a flexible sling rod 12 and sling rod mount 14 having at least a portion is an arcuate form, depending on the overall design desired.

The embodiment shown in FIG. 4 includes a transparent table top 22 mounted to frame 2 so that table top 22 is substantially horizontal. Table top 22 may be mounted to frame 2 in any of a wide variety of ways. For example, table top 22 may be mounted to frame 2 by adhesives, gravity, fasteners, brackets, clips, flanges, etc. The orientation of frame 2 to table top 22 may also vary. For example, frame 2 may circumscribe or surround the periphery of the table top 22, as shown with FIGS. 2A, 2B, 6. Alternatively, table top 22 may rest on the top of frame 2 directly or indirectly through some other form of mounting element, as shown in FIGS. 3-5, 7. Optionally, in some embodiments, table top 22 may rest within a groove or slot (not shown) within a transverse member 4 or leg 6, whether in a balanced mount on multiple sides, or in a floating cantilever configuration. In some embodiments, table top 22 may be supported by sling 10 and/or sling rod mounts 14, so long as that structure is sufficiently rigid to provide the desired support.

Figure 7:
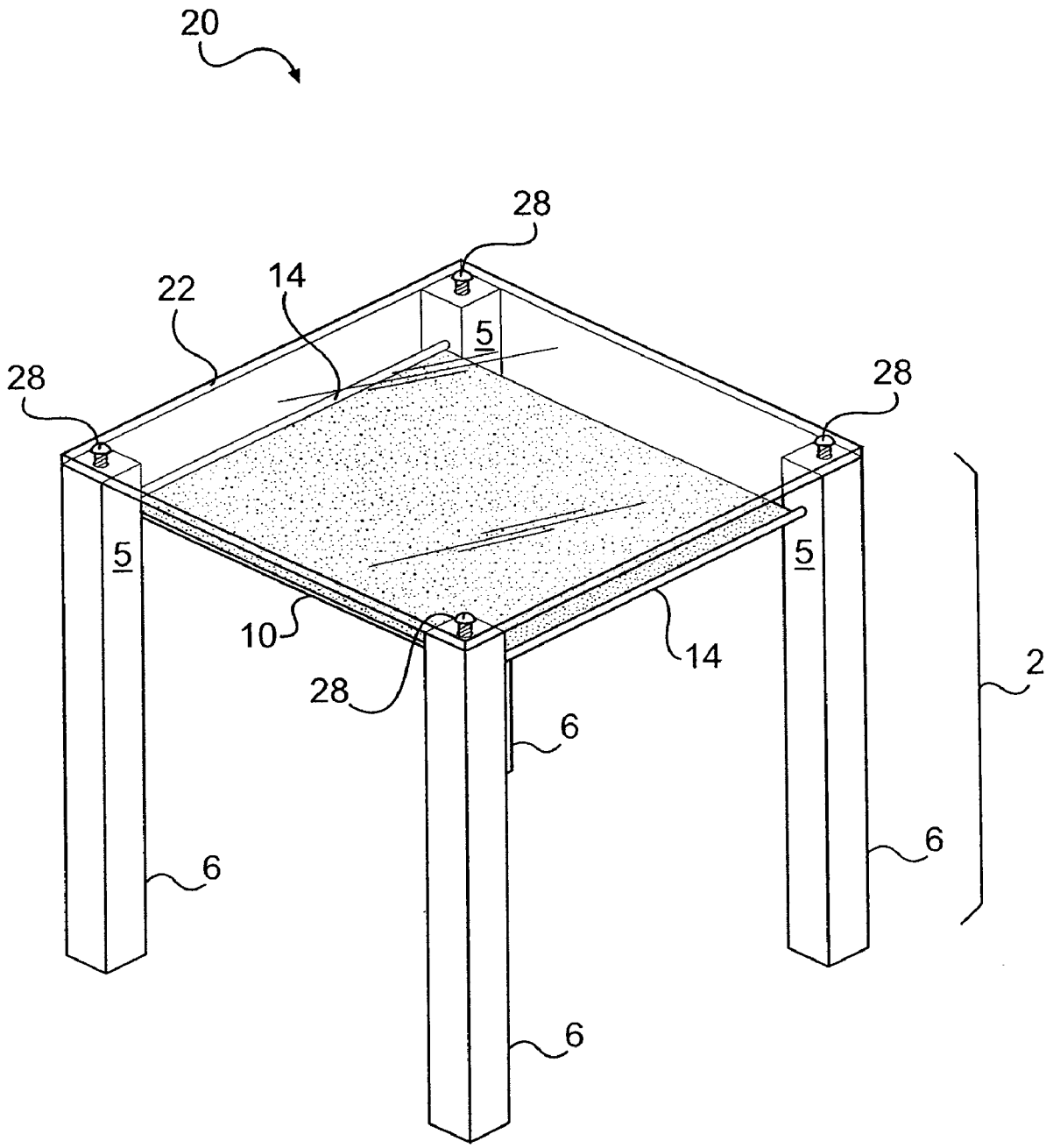
FIG. 7 is a top perspective view of an embodiment of the present invention.

FIG. 7 is a perspective view of an embodiment having a frame 2 with no transverse members 4 and sling 10 (visible largely through transparent table top 22) positioned a bit further beneath table top 22. Inner opening 8 is thus defined by inner surfaces 5 of legs 6. Sling mounts 14 are positioned between legs 6 as shown, and may optionally provide transverse rigidity to table 20. Preferably sling mounts 14 are sufficiently rigid to avoid deflection given that sling mounts are affixed to legs 6 only. Each of legs 6 may have a glass fastener 28 or other mounting mechanism at or near its top end/upper portion. As may be seen in FIG. 7, placement of sling 10 with respect to table top 22 may permit additional structure (not shown), such as storage drawers or shelves; preferably however, such additional structure would permit access to sling mounts 14 for adjustment or replacement of sling 10.

Figure 8:
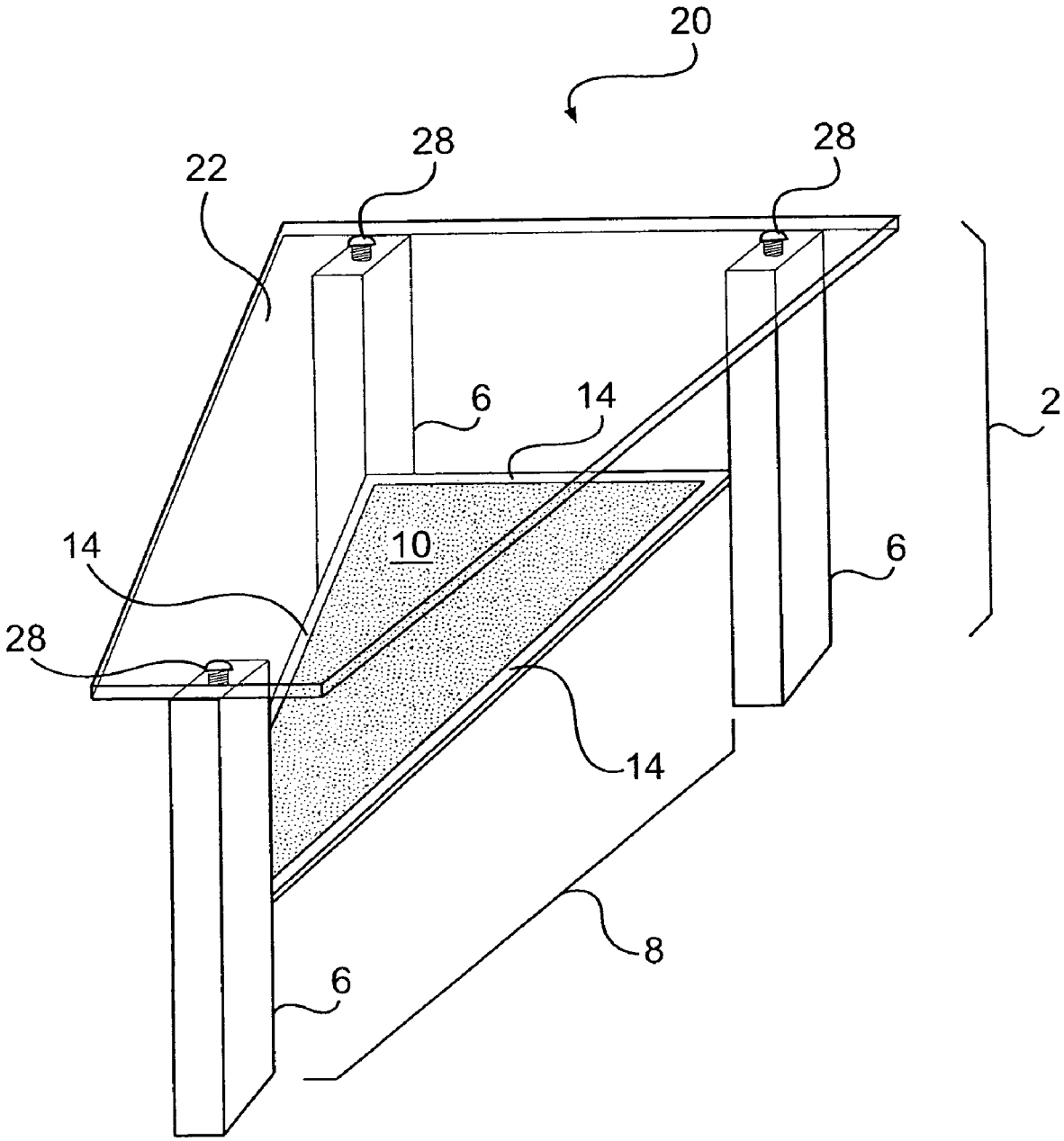
FIG. 8 is a top perspective view of a three legged embodiment of the present invention.

In an alternative embodiment shown in FIG. 8, table 20 includes three legs 6 and frame 2 has no transverse members 4. Sling 10 is mounted beneath table top 22. Like the embodiment of FIG. 7, each of legs 6 may have a glass fastener 28 or other mounting mechanism at or near its top end. Inner opening 8 in this embodiment is defined by inner surfaces 5 of legs 6. Sling mounts 14 may be affixed onto legs 6. Preferably sling mounts 14 are sufficiently rigid to avoid deflection given that sling mounts are affixed to legs 6. Table top 22 mounts directly to the glass fastener 28 of each leg 6, providing some transverse rigidity. Thus, transverse rigidity may be provided by table top 22, sling mounts 14, or perhaps by an optional lower surface shelf (not shown).

Figure 9:
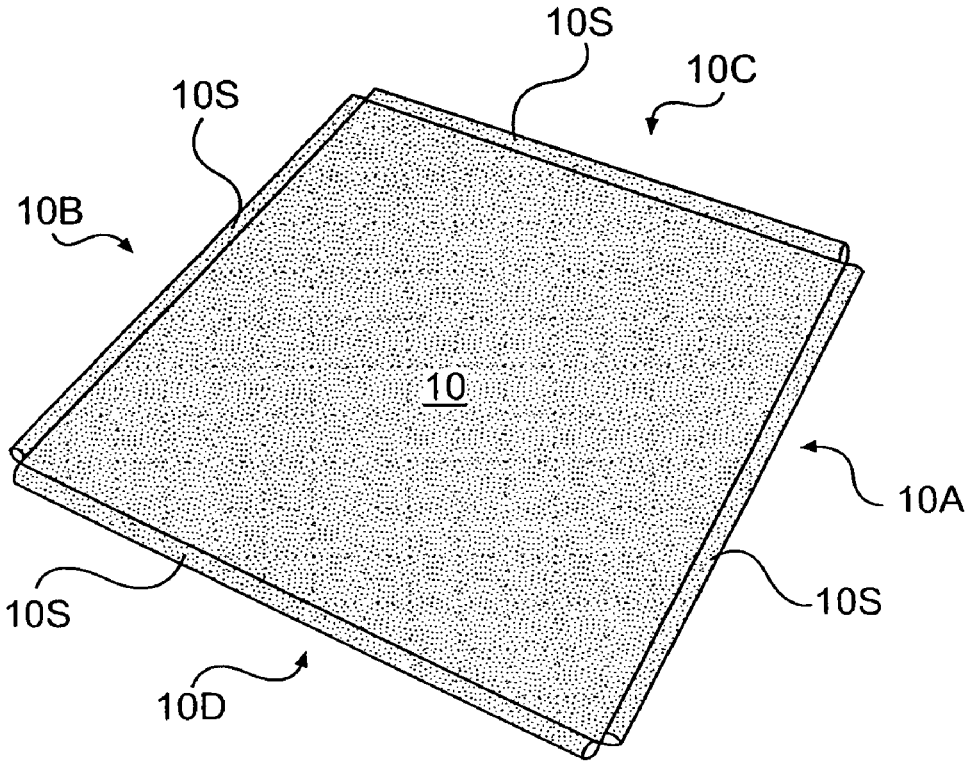
FIG. 9 illustrates a sling of an embodiment of the present invention.

The order of assembly may vary, depending on the embodiment of table 20. FIG. 9 shows an example of a square sling 10, with sleeves 10S on all four edges 10A-10D. As shown in FIG. 10, sling rods 12 may be inserted into sleeves 10S via access holes 10H, such that sling rods 12 rest in inner channels 10T.

Figure 11:
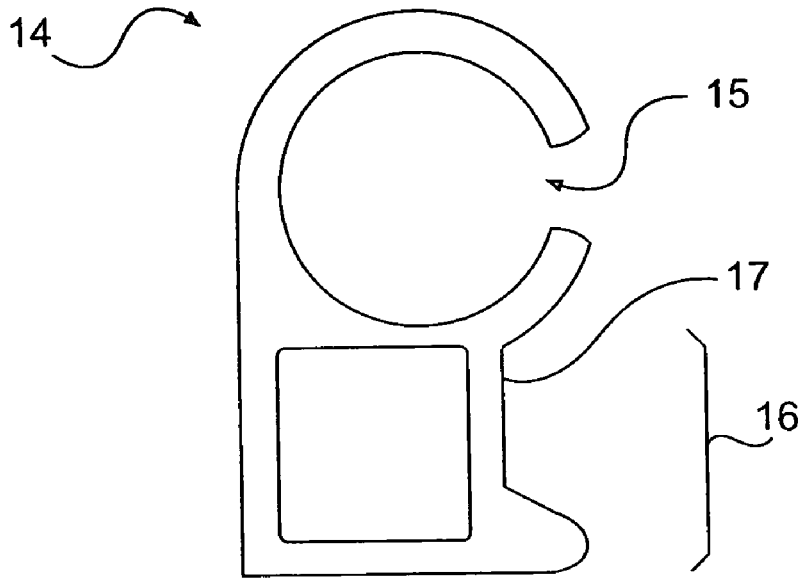
FIG. 11 is a side view of an example of a sling rod mount of an embodiment of the present invention.

FIG. 11 is a side view detail of a C-shaped embodiment of sling rod mount 14, which is similar to the embodiment depicted in FIG. 4. Sling rod mount 14 may be fabricated from a variety of resilient materials, so long as sling rod mount 14 may receive sling rods 12 (not shown) via annular opening 15 defined by the C-shape, and thereby support sling 10 for the particular design. Depending on the embodiment, sling rod mount 14 may be substantially the same length as sling rod 12, longer than sling rod 12, or shorter than sling rod 12, so long as it is able to support sling 10.

An aspect of the invention is that sling rod mount 14 may include optional fastening member 16 integrated with sling rod mount 14. Fastening member 16 in this example is shown depending from sling rod mount 14 to present a surface 17 that permits mounting of sling rod mount 14 to transverse member 4 without interfering with or requiring a hole in sling 10. As shown, fastening member 16 forms a rectangular truss cross section for enhanced rigidity; other truss shapes, such as a Pratt or triangular cross section may be used, depending on the embodiment.

Figure 12:
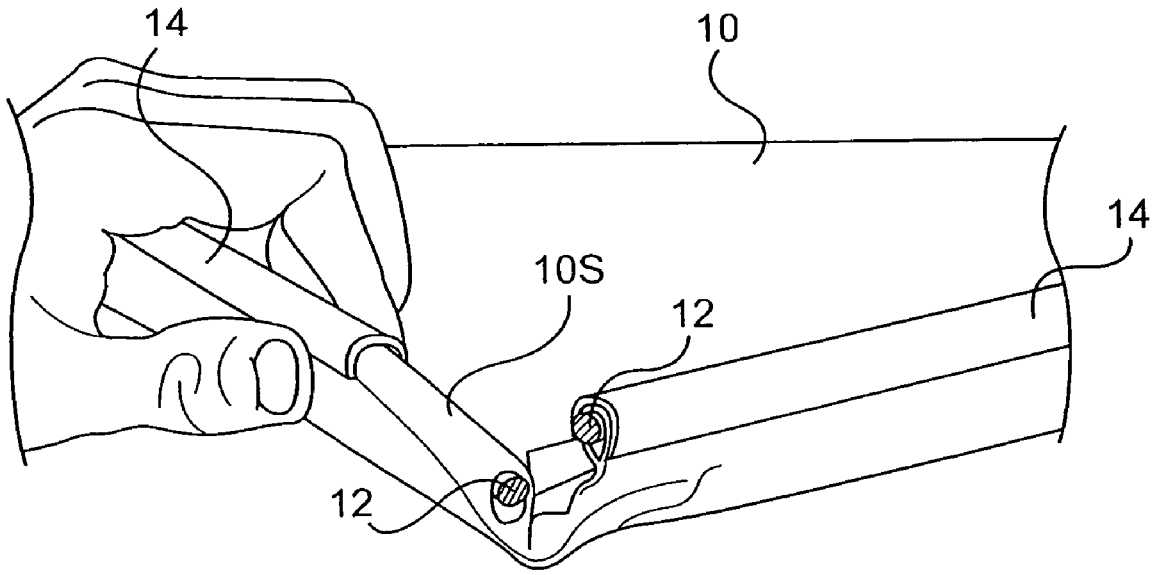
FIG. 12 illustrates exemplary sling, sling rods, and sling rod mounts of an embodiment of the present invention during assembly.

As shown in FIG. 12, the sling rods 12 within sleeves 10S may be placed within sling rod mounts 14 via annular opening 15 (filled with material from sling 10). In this way, sling rod mounts 14 receive, engage, and retain sling rods 12. Optionally, an aspect of the invention is that sling rods mounts 14 may be configured to removably retain sling rods 12. That is, an aspect of the invention are sling rod mounts 14 as a member of flexible or resilient material with appropriate sized C-shape and annular opening 15 along its length for removable receipt of sling rods 12. Annular opening 15 may be sized with respect to the diameter of sling rods 12 so as to receive and removably retain sling rods 10. Aside from any structural needs for table 20, sling rod mounts 14 are generally sufficiently elongated to support sling 10 as desired.

Figure 13:
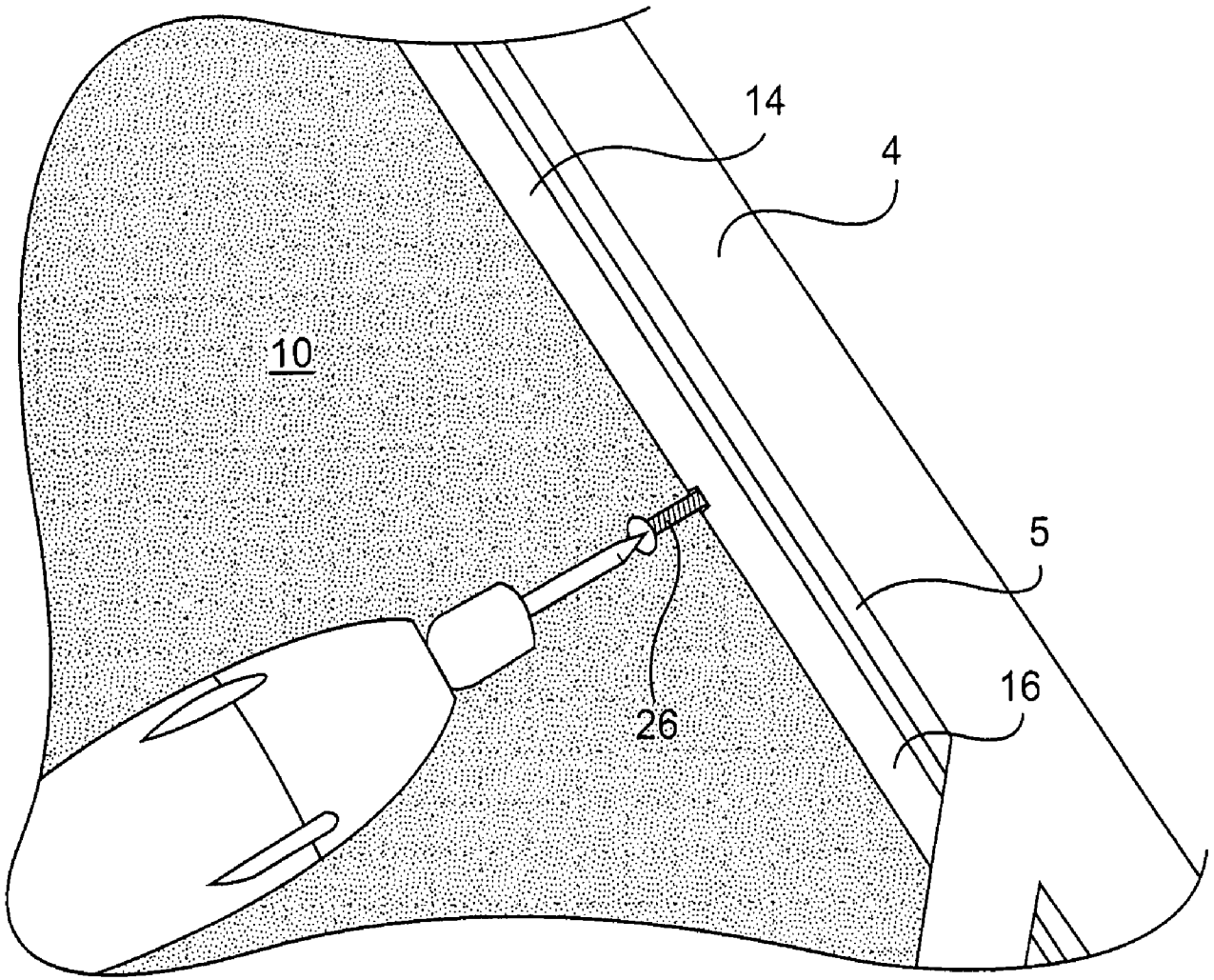
FIG. 13 illustrates affixation of a sling rod mount to a frame transverse member for an embodiment of the present invention.

FIG. 13 illustrates a method of mounting sling rod mount 14 onto transverse member 4; in this example, fastener 26 affixes sling rod mount 14 to frame 2 (not shown in its entirety) by affixing fastening member 16 to transverse member 4. Thus, the underside of sling 10 is shown in this figure. Sling 10 may be sized so that as sling rod mount 14 is affixed to transverse member 4, sling 10 may be brought to a desired level of tightness. Alternatively, for those embodiments of sling rod mount 14 lacking fastening member 16, fastener 26 may affix sling rod mount 14 to frame 2 through annular opening 15 (not shown), so long as fastener 26 does not interfere with sling rod 12. As shown by partial top view of FIG. 2B, transparent table top 22 may then be placed or mounted onto frame 2.

It is to be understood that the invention is not to be limited to the exact configuration as illustrated and described herein. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A sling table, comprising: a frame having an upper portion and at least one leg depending therefrom as a lower portion of the frame, wherein the frame defines an inner opening having a desired shape in a horizontal plane and at least a first and a second substantially opposing inner surfaces; a transparent table top mounted to the upper portion of the frame in a substantially horizontal orientation; at least two sling rods; a fabric sling having a shape and size so as to fit within the inner opening, such that at least a first and second substantially opposing edges of the sling may be positioned substantially proximate to the opposing inner surfaces of the frame, the sling further having at least a first and second sleeve located at and along the first and second opposing edges of the sling, the first and second sleeves defining inner channels along the length of the first and second opposing edges, the sling further defining at least one access hole in communication with each of the inner channels, the sleeves each adapted to receive the at least two sling rods via the access holes; at least two elongated and resilient sling rod mounts affixed to opposing inner surfaces of the frame, said sling rod mounts sized to receive the at least two sling rods located within the first and second sleeves; wherein the sling and sling rod mounts are configured such that the mounted sling is visible through the transparent table top; and wherein the lower portion of the frame is adapted to support the sling and table top at a desired height.

2. A sling table according to claim 1, wherein the frame further comprises at least one leg.

3. A sling table according to claim 1, wherein the frame further comprises a plurality of legs.

4. A sling table according to claim 1, wherein the frame further comprises a plurality of legs and at least one transverse member interposed between at least two of the plurality of legs.

5. A sling table according to claim 1, wherein the upper portion of the frame further defines an upper surface and the transparent table top is mounted onto at least a portion of the upper surface.

6. A sling table according to claim 1, wherein the table top is removably mounted to the upper portion of the frame.

7. A sling table according to claim 1, wherein the transparent table top is selected from the group of silica based glass, non-silica glass, safety glass, crystal, and plastic.

8. A sling table according to claim 1, wherein the sling rod mounts removably receive the at least two sling rods located within the first and second sleeves.

9. A sling table according to claim 1, wherein the sling rod mounts are an elongated and resilient member having a C-shaped cross section forming an annular opening along its length, wherein the sling rod mounts and annular opening are configured to receive the at least two sling rods located within the first and second sleeves.

10. A sling table according to claim 9, wherein the sling rod mounts are secured to the frame having at least one integrated fastening member.

11. A sling table according to claim 9, wherein the sling rod mounts further comprise a truss shaped cross section and at least one integrated fastening member.

12. A sling table according to claim 9, wherein the sling rod mounts further comprise a rectangular truss shaped cross section and at least one integrated fastening member.

13. A sling table according to claim 1, wherein the first and second substantially opposing inner surfaces are downward facing.

14. A sling table according to claim 1, wherein the at least two sling rods are substantially rigid.

15. A sling table, comprising: a frame having an upper portion and at least one leg depending therefrom as a lower portion of the frame, wherein the frame defines an inner opening having a desired shape in a horizontal plane and at least a first and second substantially opposing inner surfaces; a transparent table top mounted to the upper portion of the frame in a substantially horizontal orientation; at least one sling rod; a fabric sling having a shape and size so as to fit within the inner opening, such that at least a first and second opposing edges of the sling may be positioned substantially proximate to opposing inner surfaces of the frame, the sling further having at least one sleeve located at and extending along the first and second opposing edges of the sling, the at least one sleeve defining an inner channel along the length of the first and second opposing edges, the sling further defining at least one access hole in communication with the inner channel, the sleeve adapted to receive the at least one sling rod via the access hole, wherein at least a portion of the opposing edges of the sling is arcuate; at least one elongated and resilient sling rod mount affixed to the frame at opposing inner surfaces of the frame, said sling rod mount sized to receive the at least one sling rod located within the at least one sleeve, wherein at least a portion of the sling rod mount is arcuate; wherein the sling and at least one sling rod mount are configured such that the mounted sling is visible through the transparent table top; and wherein the lower portion of the frame is adapted to support the sling and table top at a desired height.

16. A sling table according to claim 15, wherein the frame further comprises at least one leg.

17. A sling table according to claim 15, wherein the frame further comprises a plurality of legs.

18. A sling table according to claim 15, wherein the frame further comprises a plurality of legs and at least one transverse member interposed between at least two of the plurality of legs.

19. A sling table according to claim 15, wherein the upper portion of the frame further defines an upper surface and the transparent table top is mounted onto at least a portion of the upper surface.

20. A sling table according to claim 15, wherein the table top is removably mounted to the upper portion of the frame.

21. A sling table according to claim 15, wherein the transparent table top is selected from the group of silica based glass, non-silica glass, safety glass, crystal, and plastic.

22. A sling table according to claim 15, wherein the at least one sling rod mount removably receives the at least one sling rod located within the at least one sleeve.

23. A sling table according to claim 15, wherein the at least one sling rod mount is an elongated and resilient member having a C-shaped cross section forming an annular opening along its length, wherein the sling rod mount and annular opening is configured to receive the at least one sling rod located within the at least one sleeve.

24. A sling table according to claim 23, wherein the at least one sling rod mount is secured to the frame having at least one integrated fastening member.

25. A sling table according to claim 23, wherein the at least one sling rod mount further comprises a truss shaped cross section and at least one integrated fastening member.

26. A sling table according to claim 23, wherein the at least one sling rod mount further comprises a rectangular truss shaped cross section and at least one integrated fastening member.

27. A sling table according to claim 15, wherein the first and second substantially opposing inner surfaces are downward facing.

28. A sling table according to claim 15, wherein the at least one sling rod is substantially flexible.

* * * * *